US011506201B2

(12) United States Patent
Fukaya

(10) Patent No.: US 11,506,201 B2
(45) Date of Patent: Nov. 22, 2022

(54) SCROLL COMPRESSOR HAVING INTERMEDIATE PRESSURE CHAMBER TO SUPPLY FLUID TO COMPRESSION CHAMBERS VIA TWO SUPPLY PASSAGES AND TWO INJECTION PORTS TO LIMIT REDUCTION IN COMPRESSION EFFICIENCY

(71) Applicant: KABUSHIKI KAISHA TOYOTA JIDOSHOKKI, Aichi-ken (JP)

(72) Inventor: Yoshihiro Fukaya, Kariya (JP)

(73) Assignee: KABUSHIKI KAISHA TOYOTA JIDOSHOKKI, Aichi-Ken (JP)

( * ) Notice: Subject to any disclaimer, the term of this patent is extended or adjusted under 35 U.S.C. 154(b) by 0 days.

(21) Appl. No.: 17/213,904

(22) Filed: Mar. 26, 2021

(65) Prior Publication Data

US 2021/0301820 A1 Sep. 30, 2021

(30) Foreign Application Priority Data

Mar. 31, 2020 (JP) ..... JP2020-064653

(51) Int. Cl.
*F04C 18/02* (2006.01)
*F04C 29/12* (2006.01)
*F04C 23/00* (2006.01)

(52) U.S. Cl.
CPC ..... *F04C 18/0261* (2013.01); *F04C 18/0215* (2013.01); *F04C 23/008* (2013.01); *F04C 29/128* (2013.01); *F04C 2210/26* (2013.01); *F04C 2240/30* (2013.01)

(58) Field of Classification Search
CPC ..... F04C 18/0261; F04C 18/0215; F04C 23/008; F04C 29/128; F04C 2210/26; F04C 2240/30
See application file for complete search history.

(56) References Cited

U.S. PATENT DOCUMENTS

2015/0192126 A1 7/2015 Nagano et al.
2015/0192127 A1* 7/2015 Nagano ..... F04C 28/24 417/410.5

FOREIGN PATENT DOCUMENTS

JP 2015-129468 A 7/2015
JP 2015-129475 A 7/2015

* cited by examiner

*Primary Examiner* — Dominick L Plakkoottam
*Assistant Examiner* — Paul W Thiede
(74) *Attorney, Agent, or Firm* — Greenblum & Bernstein, P.L.C.

(57) ABSTRACT

The distance between openings of two supply passages that are closest to an accommodating recess is less than the distance between openings of two injection ports that are closest to compression chambers. This configuration minimizes the volume of the space in the accommodating recess between a check valve and the two supply passages, unlike a case in which the distance between the openings of the supply passages that are closest to the accommodating recess is greater than or equal to the distance between the openings of the two injection ports that are closest to the compression chambers. This reduces the flow rate of refrigerant that flows into the accommodating recess from the compression chambers in a compression process through the injection ports and the supply passages.

5 Claims, 7 Drawing Sheets

SCROLL COMPRESSOR HAVING INTERMEDIATE PRESSURE CHAMBER TO SUPPLY FLUID TO COMPRESSION CHAMBERS VIA TWO SUPPLY PASSAGES AND TWO INJECTION PORTS TO LIMIT REDUCTION IN COMPRESSION EFFICIENCY

BACKGROUND

1. Field

The present disclosure relates to a scroll compressor.

2. Description of Related Art

A scroll compressor includes a housing that accommodates a compression mechanism. The compression mechanism includes compression chambers. The compression chambers compress refrigerant that has been drawn into the compression chambers. The compression mechanism discharges the compressed refrigerant. The compression mechanism includes a fixed scroll and a movable scroll. The compression chambers are formed by the fixed scroll and the movable scroll meshing with each other.

Japanese Laid-Open Patent Publication No. 2015-129475 discloses a scroll compressor that includes a housing incorporating a compression mechanism. The housing includes an intermediate pressure chamber. Refrigerant of an intermediate pressure is introduced into the intermediate pressure chamber from the external refrigerant circuit. The intermediate pressure is higher than the suction pressure of the refrigerant drawn into the compression chambers and lower than the discharge pressure of the refrigerant discharged from the compression chambers. The compression mechanism includes two injection ports, which respectively introduce the refrigerant of the intermediate pressure in the intermediate pressure chamber into two of the compression chambers. The housing includes two supply passages, which are connected to the intermediate pressure chamber and supply the refrigerant of the intermediate pressure chamber to the injection ports. The housing further incorporates a check valve. The check valve prevents backflow of the refrigerant from the compression chambers via the supply passages and the injection ports. During a high load operation of the scroll compressor, the check valve opens, so that refrigerant of the intermediate pressure, which is introduced into the intermediate pressure chamber from the external refrigerant circuit, is introduced into two of the compression chambers via the supply passages and the injection ports. This increases the flow rate of the refrigerant introduced to the compression chambers, thereby improving the performance of the motor-driven compressor during a high load operation.

In order to increase the flow rate of the refrigerant of the intermediate pressure introduced into the compression chambers from the injection ports, the diameter of the injection ports may be increased. However, an increase in the diameter of the injection ports may prevent the openings of the injection ports on the side corresponding to the compression chambers from being completely closed by the movable scroll during a compression process of the scroll compressor. This may cause the refrigerant to flow to the intermediate pressure chamber from the compression chambers in a compression process through the injection ports and the supply passages, reducing the compression efficiency. Therefore, the space in the intermediate pressure chamber that is between the check valve and the supply passages may become a dead volume, which is desired to be minimized.

SUMMARY

It is an objective of the present disclosure to provide a scroll compressor that limits reduction in compression efficiency.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a scroll compressor includes a compression mechanism and a housing. The compression mechanism that includes a fixed scroll and a movable scroll, and compression chambers, which are formed by meshing of the fixed scroll and the movable scroll. The compression mechanism compresses refrigerant that has been drawn into the compression chambers, and discharges the compressed refrigerant. The housing includes an intermediate pressure chamber. Refrigerant of an intermediate pressure is introduced into the intermediate pressure chamber from an external refrigerant circuit. The intermediate pressure is higher than a suction pressure of the refrigerant drawn into the compression chambers and lower than a discharge pressure of the refrigerant discharged from the compression chambers. The compression mechanism includes two injection ports, which respectively introduce the refrigerant of the intermediate pressure in the intermediate pressure chamber into two of the compression chambers. The housing includes two supply passages and a check valve. The two supply passages are connected to the intermediate pressure chamber and respectively supply the refrigerant of the intermediate pressure to the two injection ports. The check valve prevents backflow of the refrigerant from the compression chambers via the supply passages and the injection ports. A distance between openings of the two supply passages that are closest to the intermediate pressure chamber is less than a distance between openings of the two injection ports that are closest to the compression chambers.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

A scroll compressor 10 according to an embodiment will now be described with reference to FIGS. 1 to 7. The scroll compressor 10 of the present embodiment is used, for example, in a vehicle air conditioner.

Figure 1:
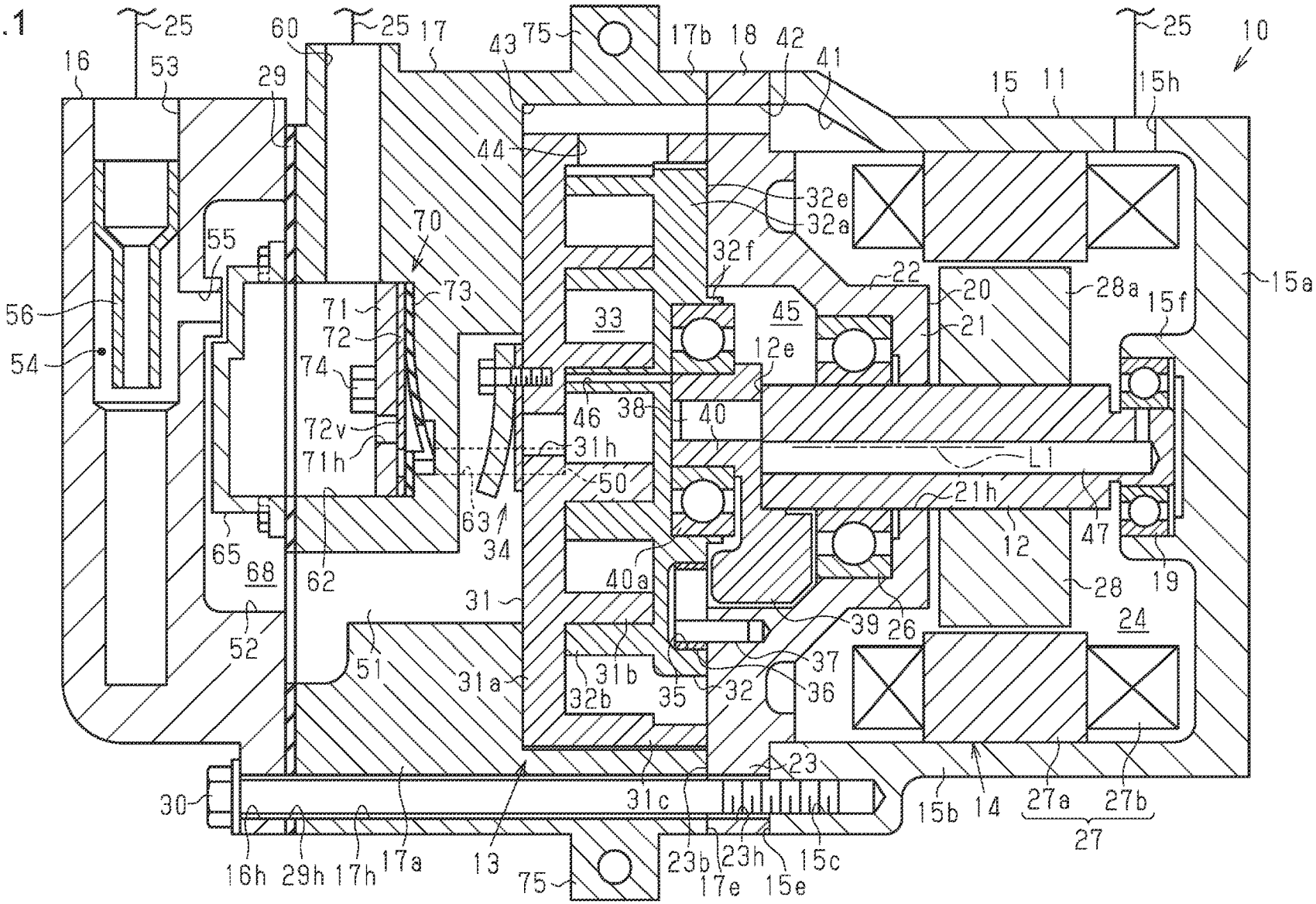
FIG. 1 is a cross-sectional side view showing a scroll compressor according to an embodiment.

As shown in FIG. 1, the scroll compressor 10 includes a tubular housing 11, a rotary shaft 12 accommodated in the housing 11, a compression mechanism 13, which is driven by rotation of the rotary shaft 12, and an electric motor 14, which rotates the rotary shaft 12.

The housing 11 includes a motor housing member 15, a discharge housing member 16, an intermediate housing member 17, and a shaft support housing member 18. The motor housing member 15, the discharge housing member 16, the intermediate housing member 17, and the shaft support housing member 18 are made of metal such as aluminum.

The motor housing member 15 has a bottom wall 15*a* and a tubular peripheral wall 15*b*, which extends from the outer circumference of the bottom wall 15*a*. The motor housing member 15 has a tubular shape with a closed end. An axial direction of the peripheral wall 15*b* agrees with an axial direction of the rotary shaft 12. The peripheral wall 15*b* has internal thread holes 15*c* at the open end. The peripheral wall 15*b* also has a suction port 15*h*. The suction port 15*h* is formed in a part of the peripheral wall 15*b* that is relatively close to the bottom wall 15*a*. The suction port 15*h* connects the inside and the outside of the motor housing member 15 to each other.

The bottom wall 15*a* has a cylindrical boss 15*f* protruding from the inner surface. The rotary shaft 12 has a first end inserted into the boss 15*f*. A bearing 19 is provided between the inner circumferential surface of the boss 15*f* and the outer circumferential surface of a first end of the rotary shaft 12. The bearing 19 is, for example, a rolling-element bearing. The first end of the rotary shaft 12 is rotationally supported by the motor housing member 15 with the bearing 19.

Figure 2:
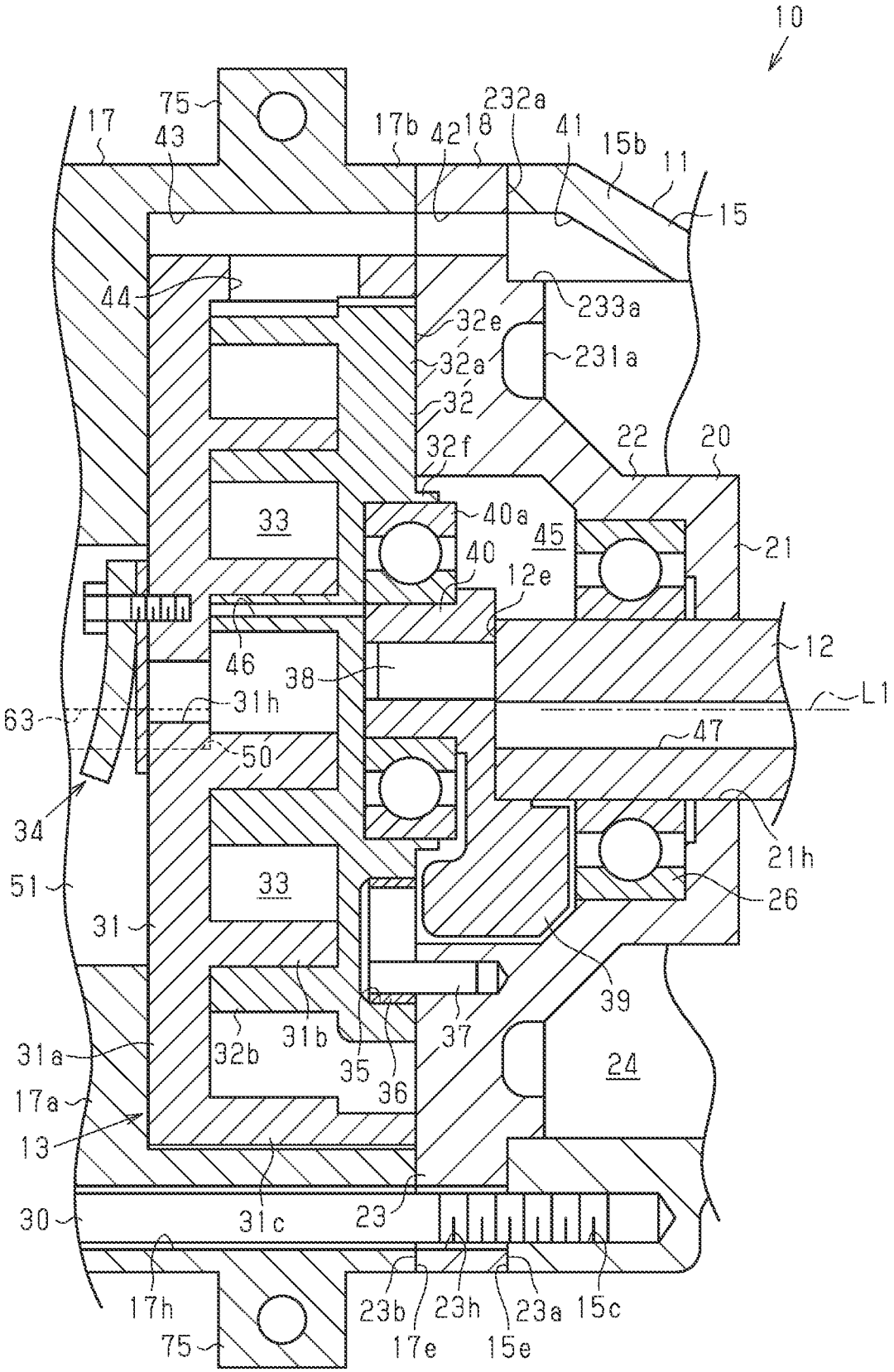
FIG. 2 is an enlarged cross-sectional view showing a part of the scroll compressor.

As shown in FIG. 2, the shaft support housing member 18 has a main body 20, which has a tubular shape with a closed end. The main body 20 has a plate-shaped bottom wall 21 and a tubular peripheral wall 22, which extends from the outer circumference of the bottom wall 21. The main body 20 has an insertion hole 21*h*, into which the rotary shaft 12 is inserted, at the center of the bottom wall 21. The shaft support housing member 18 thus has the circular insertion hole 21*h*, into which the rotary shaft 12 is inserted. The insertion hole 21*h* extends through the bottom wall 21 in the thickness direction. The axis of the insertion hole 21*h* agrees with the axis of the peripheral wall 22.

The shaft support housing member 18 has a flange 23 at an end of the peripheral wall 22 of the main body 20 on the side opposite to the bottom wall 21. The flange 23 extends outward in the radial direction of the rotary shaft 12. The flange 23 is annular. The flange 23 has an end face 23*a* located closest to the bottom wall 21. The end face 23*a* has a first surface 231*a* and a second surface 232*a*, which extend in the radial direction. The first surface 231*a* and the second surface 232*a* are annular. The first surface 231*a* is continuous with the outer circumferential surface of the peripheral wall 22 and extends in the radial direction from the end of the outer circumferential surface of the peripheral wall 22 that is on the side opposite to the bottom wall 21. The second surface 232*a* is located outward of the first surface 231*a* in the radial direction. The second surface 232*a* is farther from the bottom wall 21 than the first surface 231*a* in the axial direction of the rotary shaft 12. The outer peripheral edge of the first surface 231*a* on the outer side in the radial direction is connected to the inner peripheral edge of the second surface 232*a* on the inner side in the radial direction by a step surface 233*a*, which extends in the axial direction. The step surface 233*a* is annular.

The second surface 232*a* faces an open end face 15*e* of the peripheral wall 15*b* of the motor housing member 15. The flange 23 has bolt insertion holes 23*h* in the outer circumference. The bolt insertion holes 23*h* extend through the flange 23 in the thickness direction. The bolt insertion holes 23*h* open in the second surface 232*a* of the flange 23. The bolt insertion holes 23*h* are connected to the internal thread holes 15*c* of the motor housing member 15. The motor housing member 15 and the shaft support housing member 18 define a motor chamber 24 formed in the housing 11. Refrigerant is drawn into the motor chamber 24 from an external refrigerant circuit 25 via the suction port 15*h*. The motor chamber 24 is thus a suction chamber, into which refrigerant is drawn through the suction port 15*h*.

An end face 12*e* of the second end of the rotary shaft 12 is located on the inner side of the peripheral wall 22 of the main body 20. A bearing 26 is provided between the inner circumferential surface of the peripheral wall 22 and the outer circumferential surface of the rotary shaft 12. The bearing 26 is, for example, a rolling-element bearing. The rotary shaft 12 is rotationally supported by the shaft support housing member 18 with the bearing 26. The shaft support housing member 18 thus rotationally supports the rotary shaft 12.

As shown in FIG. 1, the motor chamber 24 accommodates the electric motor 14. The motor housing member 15 therefore incorporates the electric motor 14. The electric motor 14 includes a tubular stator 27 and a rotor 28, which is arranged on the inner side of the stator 27. The rotor 28 rotates integrally with the rotary shaft 12. The stator 27 surrounds the rotor 28. The rotor 28 includes a rotor core 28*a*, which is fixed to the rotary shaft 12, and permanent magnets (not shown), which are provided on the rotor core 28*a*. The stator 27 includes a tubular stator core 27*a* and a coil 27*b*. The stator core 27*a* is fixed to the inner circumferential surface of the peripheral wall 15*b* of the motor housing member 15. The coil 27*b* is wound about the stator core 27*a*. When power that is controlled by an inverter (not shown) is supplied to the coil 27*b*, the rotor 28 rotates, so that the rotary shaft 12 rotates integrally with the rotor 28.

The intermediate housing member 17 has a bottom wall 17*a* and a tubular peripheral wall 17*b*, which extends from the outer circumference of the bottom wall 17*a*. The axial direction of the peripheral wall 17*b* agrees with the axial direction of the rotary shaft 12. The peripheral wall 17*b* has an end face 17*e*, which faces an end face 23*b* of the flange 23 on the side opposite to the bottom wall 21. The intermediate housing member 17 has bolt insertion holes 17*h* in the outer circumference. The bolt insertion holes 17*h* are connected to the bolt insertion holes 23*h* of the flange 23. The bolt insertion holes 17*h* extend through the bottom wall 17*a* and the peripheral wall 17*b*.

The discharge housing member 16 is block-shaped. The discharge housing member 16 is attached to the bottom wall 17*a* of the intermediate housing member 17 with a plate-shaped gasket 29. The discharge housing member 16 is attached to an end face of the bottom wall 17*a* on the side opposite to the peripheral wall 17*b*. The gasket 29 serves as a seal between the discharge housing member 16 and the intermediate housing member 17. The gasket 29 has bolt insertion holes 29*h* in the outer circumference. The bolt insertion holes 29*h* are connected to the bolt insertion holes 17*h* of the intermediate housing member 17. The discharge housing member 16 has bolt insertion holes 16*h* in the outer circumference. The bolt insertion holes 16*h* are connected to the bolt insertion holes 29*h*.

Bolts 30, which are passed through the bolt insertion holes 16*h*, 17*h*, 29*h*, are threaded into bolt insertion holes 23*h* of the flange 23 and the internal thread holes 15*c* of the motor housing member 15 in that order. This couples the shaft support housing member 18 to the peripheral wall 15*b* of the motor housing member 15, and couples the intermediate housing member 17 to the flange 23 of the shaft support housing member 18. Further, the discharge housing member 16 is coupled to the intermediate housing member 17 together with the gasket 29. Accordingly, the motor housing member 15, the shaft support housing member 18, the intermediate housing member 17, and the discharge housing member 16 are arranged in that order in the axial direction of the rotary shaft 12.

The flange 23 is held between the peripheral wall 17*b* of the intermediate housing member 17 and the peripheral wall 15*b* of the motor housing member 15. The intermediate housing member 17 is arranged between the discharge housing member 16 and the motor housing member 15. The intermediate housing member 17, the shaft support housing member 18, and the motor housing member 15 are integrally fixed by the bolts 30, which extend through the intermediate housing member 17 and the flange 23 and are threaded to the motor housing member 15. A plate-shaped gasket (not shown) is arranged between the outer circumference of the flange 23 and the open end face 15*e* of the peripheral wall 15*b* of the motor housing member 15. This gasket serves as a seal between the flange 23 and the peripheral wall 15*b* of the motor housing member 15. Also, a plate-shaped gasket (not shown) is arranged between the outer circumference of the flange 23 and the open end face 17*e* of the peripheral wall 17*b* of the intermediate housing member 17. This gasket serves as a seal between the flange 23 and the peripheral wall 17*b* of the intermediate housing member 17.

As shown in FIG. 2, the compression mechanism 13 includes a fixed scroll 31 and a movable scroll 32, which is arranged to face the fixed scroll 31. The compression mechanism 13 of the present embodiment is thus of a scroll type. The fixed scroll 31 and the movable scroll 32 are arranged on the inner side of the peripheral wall 17*b* of the intermediate housing member 17. The peripheral wall 17*b* of the intermediate housing member 17 thus covers the compression mechanism 13 from the outer side in the radial direction of the rotary shaft 12. Therefore, the peripheral wall 17*b* surrounds the compression mechanism 13.

The fixed scroll 31 is located between the movable scroll 32 and the bottom wall 17*a* of the intermediate housing member 17 in the axial direction of the rotary shaft 12. The fixed scroll 31 has a disc-shaped fixed base plate 31*a* and a fixed volute wall 31*b*, which extends from the fixed base plate 31*a* in a direction away from the bottom wall 17*a* of the intermediate housing member 17. The fixed scroll 31 has a tubular fixed outer peripheral wall 31*c*, which extends from the outer circumference of the fixed base plate 31*a*. The fixed outer peripheral wall 31*c* surrounds the fixed volute wall 31*b*. The fixed outer peripheral wall 31*c* has an open end face that is located at a position farther from the fixed base plate 31*a* than the distal end face of the fixed volute wall 31*b*.

The movable scroll 32 has a disc-shaped movable base plate 32*a*, which faces the fixed base plate 31*a*, and a movable volute wall 32*b*, which extends from the movable base plate 32*a* toward the fixed base plate 31*a*. The fixed volute wall 31*b* and the movable volute wall 32*b* mesh with each other. The movable volute wall 32*b* is located on the inner side of the fixed outer peripheral wall 31*c*. The distal end face of the fixed volute wall 31*b* contacts the movable base plate 32*a*. The distal end face of the movable volute wall 32*b* contacts the fixed base plate 31*a*. Compression chambers 33, which compress refrigerant, are defined by the fixed base plate 31*a*, the fixed volute wall 31*b*, the fixed outer peripheral wall 31*c*, the movable base plate 32*a*, and the movable volute wall 32*b*. Therefore, the compression mechanism 13 has the compression chambers 33, which are formed by meshing of the fixed scroll 31 and the movable scroll 32, and compress refrigerant that has been drawn into the compression chambers 33. The compression mechanism 13 discharges the compressed refrigerant.

The fixed base plate 31*a* has a circular discharge port 31*h* at the central portion. The discharge port 31*h* extends through the fixed base plate 31*a* in the thickness direction. A discharge valve mechanism 34, which selectively opens and closes the discharge port 31*h*, is attached to an end face of fixed base plate 31*a* that is on the side opposite to the movable scroll 32.

The movable base plate 32*a* has a boss 32*f*, which projects from an end face 32*e* on the side opposite to the fixed base plate 31*a*. The boss 32*f* is cylindrical. The axial direction of the boss 32*f* agrees with the axial direction of the rotary shaft 12. Multiple recesses 35 are formed in the end face 32*e* around the boss 32*f*. The recesses 35 are circular holes. The recesses 35 are arranged at predetermined intervals in the circumferential direction of the rotary shaft 12. An annular ring member 36 is fitted in each of the recesses 35. The shaft support housing member 18 has pins 37, which protrude from an end face closest to the intermediate housing member 17. The pins 37 are inserted into the corresponding ring members 36.

The fixed scroll 31 is positioned in relation to the shaft support housing member 18 while being restricted from rotating about the axis L1 of the rotary shaft 12 on the inner side of the peripheral wall 17*b* of the intermediate housing member 17. The end face of the shaft support housing member 18 that is closest to the intermediate housing member 17 contacts the open end face of the fixed outer peripheral wall 31*c*. The fixed scroll 31 is held between the bottom wall 17*a* of the intermediate housing member 17 and the end face of the shaft support housing member 18 that is closest to the intermediate housing member 17. The fixed scroll 31 is thus arranged on the inner side of the peripheral wall 17*b* of the intermediate housing member 17, while being restricted from moving in the axial direction of the rotary shaft 12 on the inner side of the peripheral wall 17*b* of the intermediate housing member 17.

The rotary shaft 12 has an eccentric shaft 38, which projects from the end face 12*e* of the second end and is located at a position eccentric from the axis L1 of the rotary shaft 12. The eccentric shaft 38 protrudes toward the movable scroll 32. The axial direction of the eccentric shaft 38 agrees with the axial direction of the rotary shaft 12. The eccentric shaft 38 is inserted into the boss 32*f*.

A bushing 40, which is integrated with a balance weight 39, is fitted to the outer circumferential surface of the eccentric shaft 38. The balance weight 39 is integral with the bushing 40. The balance weight 39 is accommodated inside the peripheral wall 22 of the shaft support housing member 18. The movable scroll 32 is supported by the eccentric shaft 38 with the bushing 40 and a rolling-element bearing 40*a* so as to be rotational relative to the eccentric shaft 38.

Rotation of the rotary shaft 12 is transmitted to the movable scroll 32 via the eccentric shaft 38, the bushing 40, and the rolling-element bearing 40*a*, so that the movable scroll 32 orbits. At this time, contact between the pins 37 and the inner circumferential surfaces of the respective ring members 36 prevents the movable scroll 32 from rotating and only allows the movable scroll 32 to orbit. This causes the movable scroll 32 to orbit with the movable volute wall 32*b* contacting the fixed volute wall 31*b*. Accordingly, the volume of each compression chamber 33 decreases to compress the refrigerant. In this manner, the rotation of the rotary shaft 12 drives the compression mechanism 13. The balance weight 39 cancels out the centrifugal force acting on the movable scroll 32 when the movable scroll 32 orbits, thereby reducing the amount of imbalance of the movable scroll 32.

The motor housing member 15 has a first groove 41 formed in a part of the inner circumferential surface of the peripheral wall 15*b*. The first groove 41 opens in the open end of the peripheral wall 15*b*. Also, the flange 23 of the shaft support housing member 18 has a first hole 42 in the outer circumference. The first hole 42 is connected to the first groove 41. The first hole 42 extends through the flange 23 in the thickness direction. Further, the peripheral wall 17*b* of the intermediate housing member 17 has a second groove 43 in a part of the inner circumferential surface. The second groove 43 is connected to the first hole 42. The fixed outer peripheral wall 31*c* of the fixed scroll 31 has a second hole 44, which extends through the fixed outer peripheral wall 31*c* in the thickness direction. The second hole 44 is connected to the second groove 43. The second hole 44 is connected to the outermost part of each compression chamber 33.

The refrigerant in the motor chamber 24 is drawn into the outermost part of each compression chamber 33 through the first groove 41, the first hole 42, the second groove 43, and the second hole 44. The refrigerant that has been drawn into the outermost part of each compression chamber 33 is compressed in the compression chamber 33 by orbiting motion of the movable scroll 32.

The housing 11 has a back pressure chamber 45. The back pressure chamber 45 is arranged on the inner side of the peripheral wall 22 of the shaft support housing member 18. In the housing 11, the back pressure chamber 45 is therefore formed between the inner surface of the shaft support housing member 18 and the surface of the movable base plate 32*a* on the side opposite to the fixed base plate 31*a*. The shaft support housing member 18 defines the back pressure chamber 45 and the motor chamber 24.

The movable scroll 32 has a back pressure introducing passage 46. The back pressure introducing passage 46 extends through the movable base plate 32*a* and the movable volute wall 32*b* and introduces the refrigerant in the compression chambers 33 to the back pressure chamber 45. Since the refrigerant in the compression chambers 33 is introduced into the back pressure chamber 45 via the back pressure introducing passage 46, the pressure in the back pressure chamber 45 is higher than that of the motor chamber 24. The high pressure in the back pressure chamber 45 urges the movable scroll 32 toward the fixed scroll 31, so that the distal end face of the movable volute wall 32*b* is pressed against the fixed base plate 31*a*.

The rotary shaft 12 has an in-shaft passage 47. The in-shaft passage 47 has a first end that opens in the end face 12*e* of the rotary shaft 12. The in-shaft passage 47 has a second end that is open in a part of the outer circumferential surface of the rotary shaft 12 that is supported by the bearing 19. The in-shaft passage 47 thus connects the back pressure chamber 45 and the motor chamber 24 to each other.

Figure 3:
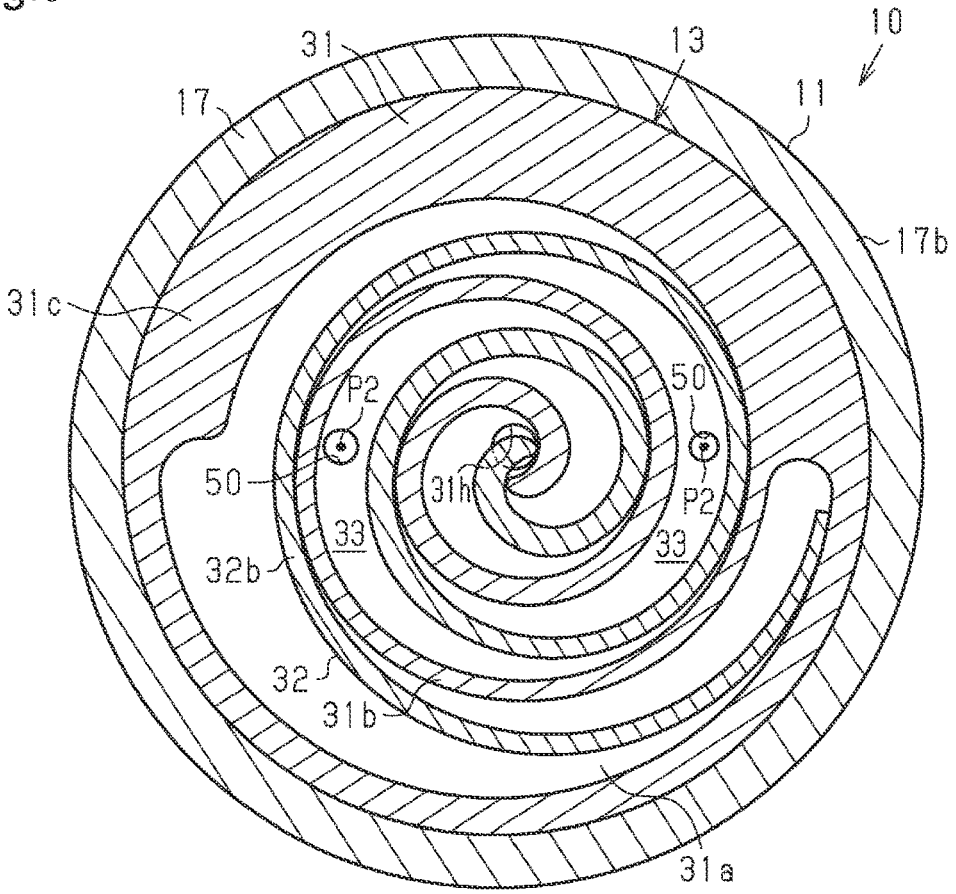
FIG. 3 is a longitudinal cross-sectional view of the scroll compressor.

As shown in FIG. 3, the fixed base plate 31*a* has two injection ports 50. Therefore, the compression mechanism 13 has the two injection ports 50. Each injection port 50 is a circular hole. The position and the size of each injection port 50 are set such that the compression chambers 33 adjacent to each other are not connected to each other by the injection ports 50 during orbiting motion of the movable scroll 32. The injection ports 50 introduce, from the external refrigerant circuit 25 into two of the compression chambers 33 that are in a compression process, refrigerant of an intermediate pressure. The intermediate pressure is higher than the suction pressure of the refrigerant drawn into the compression chambers 33 and lower than the discharge pressure of the refrigerant discharged from the compression chambers 33.

As shown in FIG. 1, the bottom wall 17*a* of the intermediate housing member 17 has a connecting passage 51, which is connected to the discharge port 31*h*. The connecting passage 51 opens in the outer surface of the bottom wall 17*a* of the intermediate housing member 17.

The discharge housing member 16 has a discharge chamber defining recess 52 in the end face closest to the intermediate housing member 17. The interior of the discharge chamber defining recess 52 is connected to the connecting passage 51. The discharge housing member 16 has a discharge port 53 and an oil separation chamber 54 connected to the discharge port 53. The discharge housing member 16 further has a passage 55 that connects the interior of the discharge chamber defining recess 52 and the oil separation chamber 54 to each other. The oil separation chamber 54 accommodates an oil separation tube 56.

The intermediate housing member 17 includes an introduction port 60, an accommodating recess 62, and two supply passages 63. Refrigerant of the intermediate pressure from the external refrigerant circuit 25 is introduced into the introduction port 60. The accommodating recess 62 is connected to the introduction port 60. The two supply passages 63 are connected to the accommodating recess 62, and supply the refrigerant of the intermediate pressure in the accommodating recess 62 to the injection ports 50. The accommodating recess 62 is formed in the end face of the intermediate housing member 17 that is closest to the discharge housing member 16. The accommodating recess 62 substantially has a rectangular shape in plan view. The opening of the accommodating recess 62 faces the discharge chamber defining recess 52. The two supply passages 63 open in the bottom surface of the accommodating recess 62.

Figure 4:
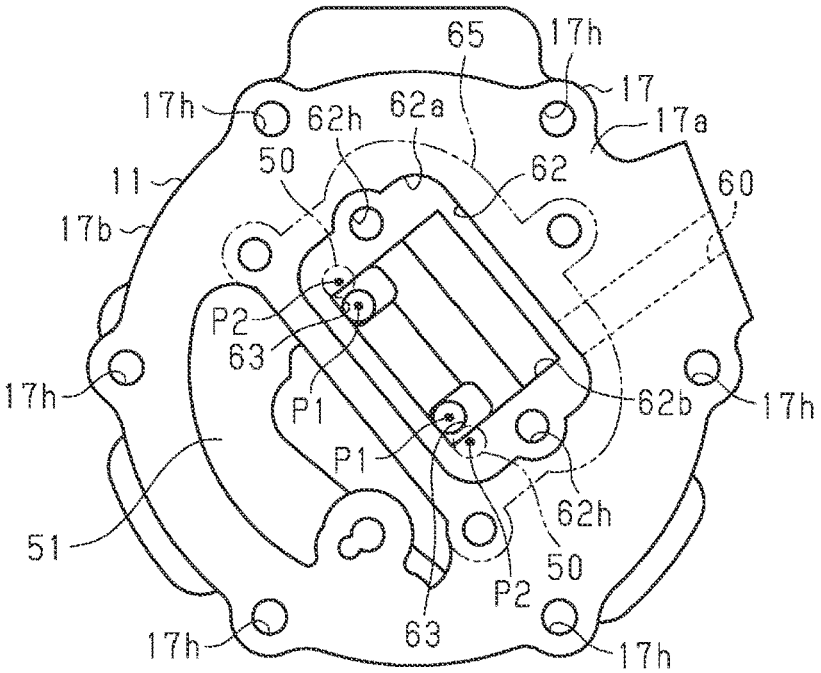
FIG. 4 is a plan view of an intermediate housing member.

As shown in FIG. 4, the accommodating recess 62 has a first recess 62*a* and a second recess 62*b*, which is formed in the bottom surface of the first recess 62*a*. Each supply passage 63 has a first end that opens in the bottom surface of the second recess 62*b*. Each supply passage 63 also has a second end that opens in the inner surface of the bottom wall 17*a* of the intermediate housing member 17 and is connected to one of the injection ports 50. The supply passages 63 are circular holes. The supply passages 63 have the same size as the injection ports 50. Two internal thread holes 62*h* are formed in the bottom surface of the first recess 62*a*.

Figure 5:
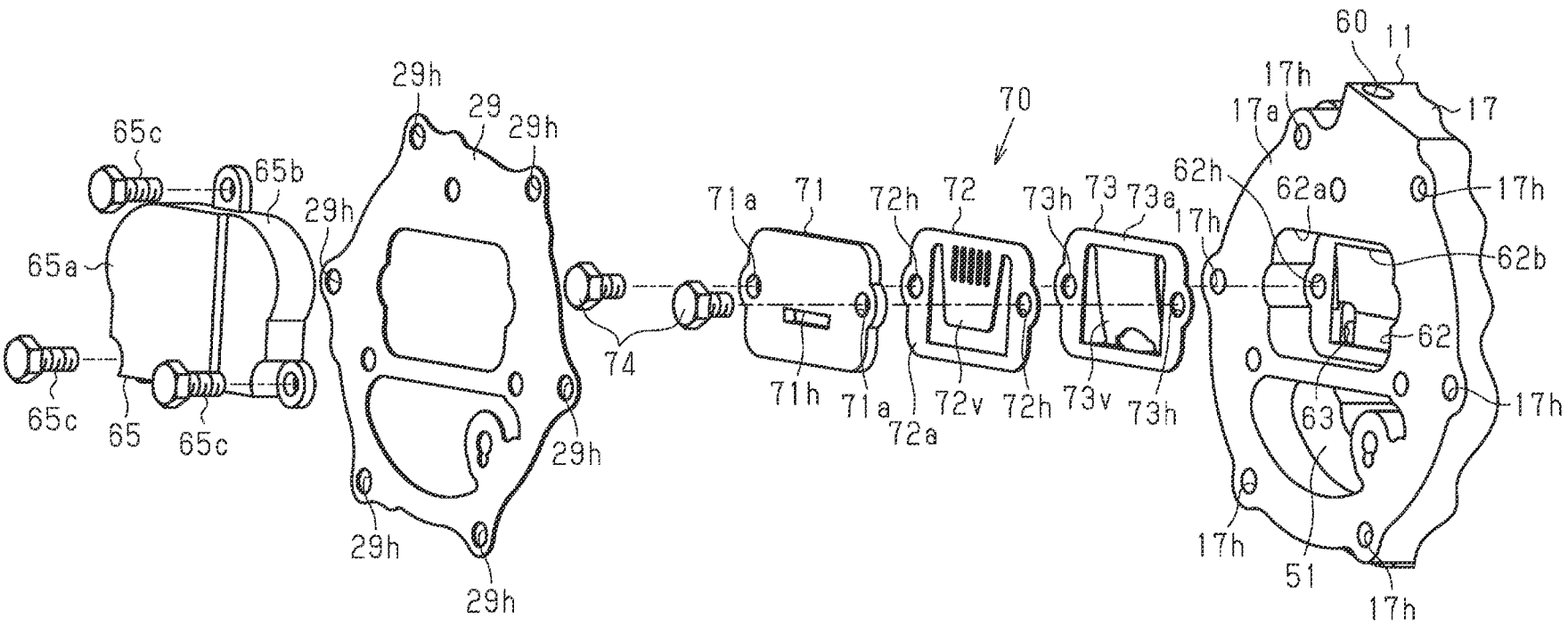
FIG. 5 is an exploded perspective view showing a part of the scroll compressor.

As shown in FIG. 5, the intermediate housing member 17 includes a check valve 70. The accommodating recess 62 accommodates the check valve 70. The intermediate housing member 17 therefore incorporates the check valve 70. The check valve 70 includes a valve plate 71, a reed valve forming plate 72, and a retainer forming plate 73.

The valve plate 71 is flat. The valve plate 71 is made of metal such as iron. The valve plate 71 has an outer shape conforming to the inner surface of the first recess 62*a*. The valve plate 71 has a single valve hole 71*h* at the center. The valve hole 71*h* is rectangular in a plan view. The valve hole 71*h* extends through the valve plate 71 in the thickness direction. The valve plate 71 has two bolt insertion holes 71*a* in the outer periphery.

The reed valve forming plate 72 is relatively thin. The reed valve forming plate 72 is made of metal such as iron. The reed valve forming plate 72 has an outer shape conforming to the inner surface of the first recess 62*a*. The reed valve forming plate 72 has an outer frame 72*a* and a reed valve 72*v*. The reed valve 72*v* protrudes from a part of the inner edge of the outer frame 72*a* toward the center of the outer frame 72*a*. The reed valve 72*v* is plate-shaped and has a trapezoidal shape in a plan view. The distal end of the reed valve 72*v* has a size capable of covering the valve hole 71*h*. The reed valve 72*v* is thus capable of opening and closing the valve hole 71*h*. The outer frame 72*a* also has two bolt insertion holes 72*h*.

The retainer forming plate 73 is relatively thin. The retainer forming plate 73 is made of rubber. The retainer forming plate 73 has an outer shape conforming to the inner surface of the first recess 62*a*. The retainer forming plate 73 has an outer frame 73*a* and a retainer 73*v*. The retainer 73*v* curves and protrudes from a part of the inner edge of the outer frame 73*a*. The retainer 73*v* limits the opening degree of the reed valve 72*v*. The retainer 73*v* is accommodated in the second recess 62*b*. The outer frame 73*a* also has two bolt insertion holes 73*h*.

The retainer forming plate 73, the reed valve forming plate 72, and the valve plate 71 are arranged in that order on the bottom surface of the first recess 62*a*. In a state in which the retainer forming plate 73, the reed valve forming plate 72, and the valve plate 71 are accommodated in the first recess 62*a*, the bolt insertion holes 71*a*, 72*h*, 73*h* are aligned. The retainer forming plate 73, the reed valve forming plate 72, and the valve plate 71 are fastened to bottom surface of the first recess 62*a* by inserting fastening bolts 74 into the bolt insertion holes 71*a*, 72*h*, 73*h* and threading the fastening bolts 74 to the internal thread holes 62*h*.

Figure 6:
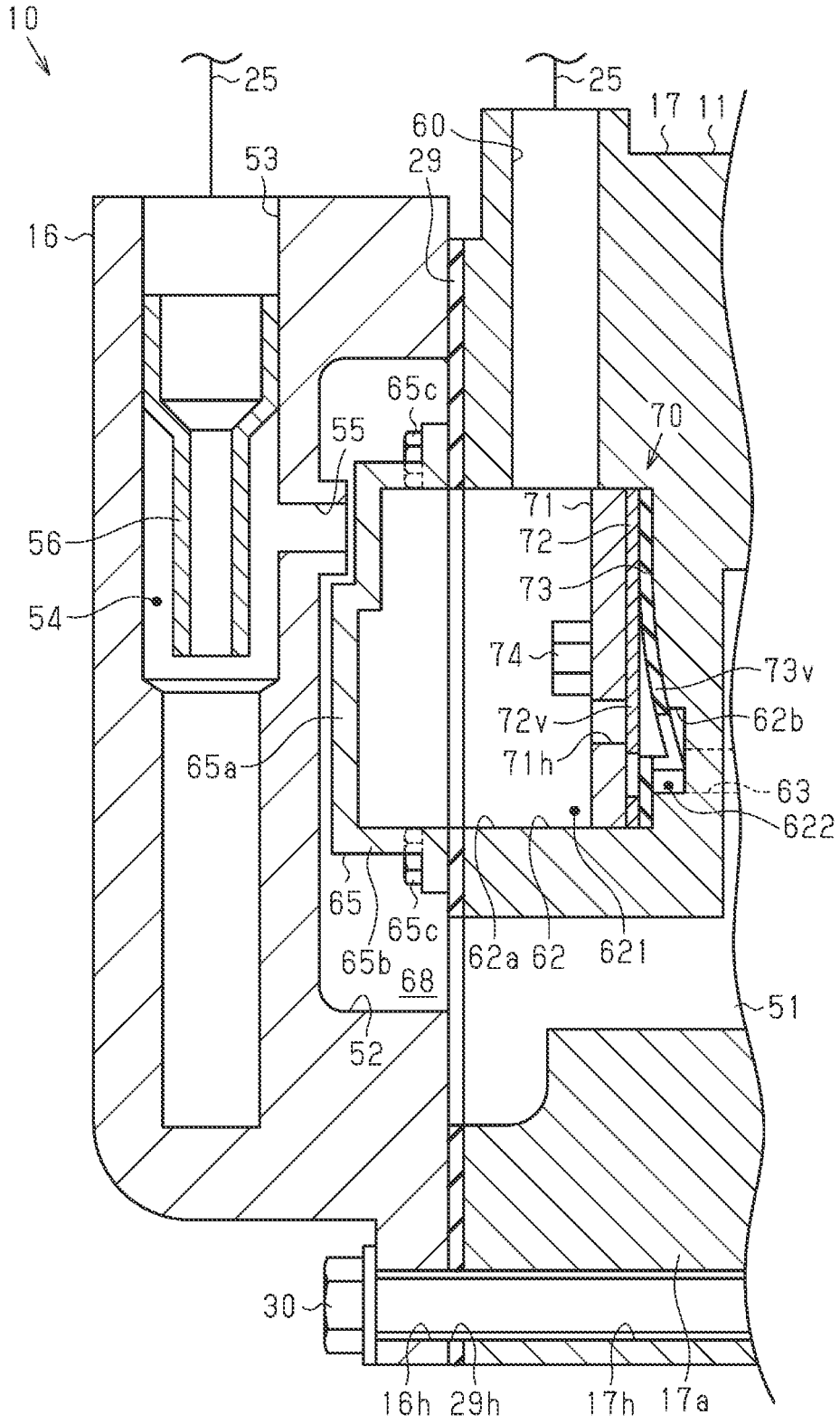
FIG. 6 is an enlarged cross-sectional view showing a part of the scroll compressor.

As shown in FIG. 6, the introduction port 60 is orthogonal to the axis L1 of the rotary shaft 12 in the inner surface of the first recess 62*a*, and opens in a section between the valve plate 71 and the discharge housing member 16. The reed valve 72*v* is arranged in a plane in the valve plate 71 that is relatively close to the supply passages 63.

A lid 65 is attached to the intermediate housing member 17 to close the opening of the accommodating recess 62. The lid 65 has a plate-shaped lid bottom wall 65*a* and a tubular lid peripheral wall 65*b*, which extends from the outer periphery of the lid bottom wall 65*a*. The lid 65 has a tubular shape with a closed end. The lid 65 is fastened to the intermediate housing member 17 with fastening bolts 65*c*. The lid 65 is arranged inside the discharge chamber defining recess 52. A part of the gasket 29 serves as a seal between the lid 65 and the intermediate housing member 17. Accordingly, the gasket 29 serves as a seal between the interior of the accommodating recess 62 and the discharge chamber defining recess 52.

The gasket 29, the discharge chamber defining recess 52, and the lid 65 define a discharge chamber 68. The discharge housing member 16 therefore has the discharge chamber 68. The accommodating recess 62 faces the discharge chamber 68. The lid 65 separates the accommodating recess 62 and the discharge chamber 68 from each other. The discharge chamber 68 is connected to the connecting passage 51. The refrigerant that has been compressed in the compression chambers 33 is discharged to the discharge chamber 68 via the discharge port 31*h* and the connecting passage 51. Therefore, the refrigerant of the discharge pressure is discharged to the discharge chamber 68 from the compression mechanism 13. The refrigerant that has been discharged to the discharge chamber 68 flows into the oil separation chamber 54 via the passage 55, and the oil separation tube 56 separates oil from the refrigerant in the oil separation chamber 54. The refrigerant, from which oil has been separated, is discharged to the external refrigerant circuit 25 from the discharge port 53.

The valve plate 71 divides the interior of the accommodating recess 62 into a first chamber 621 relatively close to the introduction port 60 and a second chamber 622 relatively close to the supply passages 63. The first chamber 621 is defined by the valve plate 71, the inner surface of the first recess 62*a*, and the lid 65. The second chamber 622 is defined by the valve plate 71 and the second recess 62*b*. The outer frame 73*a* of the retainer forming plate 73 serves as a seal between the first chamber 621 and the second chamber 622. The sealing between the first chamber 621 and the second chamber 622 in the outer frame 73*a* is ensured by fastening the fastening bolts 74.

As shown in FIG. 1, the intermediate housing member 17 has two mount legs 75 protruding from the outer circumferential surface. The mount legs 75 are tubular. The mount legs 75 protrude from the outer circumferential surface of the peripheral wall 17*b* of the intermediate housing member 17. The mount legs 75 are arranged on the opposite sides of the peripheral wall 17*b* in the radial direction, that is, on the opposite sides of the axis L1 of the rotary shaft 12. The axes of the mount legs 75 are parallel with each other. When the scroll compressor 10 is viewed in the axial direction of the rotary shaft 12, the axes of the mount legs 75 are orthogonal to the axial direction of the rotary shaft 12. The scroll compressor 10 of the present embodiment is attached to the body of a vehicle, for example, by threading bolts (not shown) that are passed through the mount legs 75 into the body of the vehicle.

Figure 7:
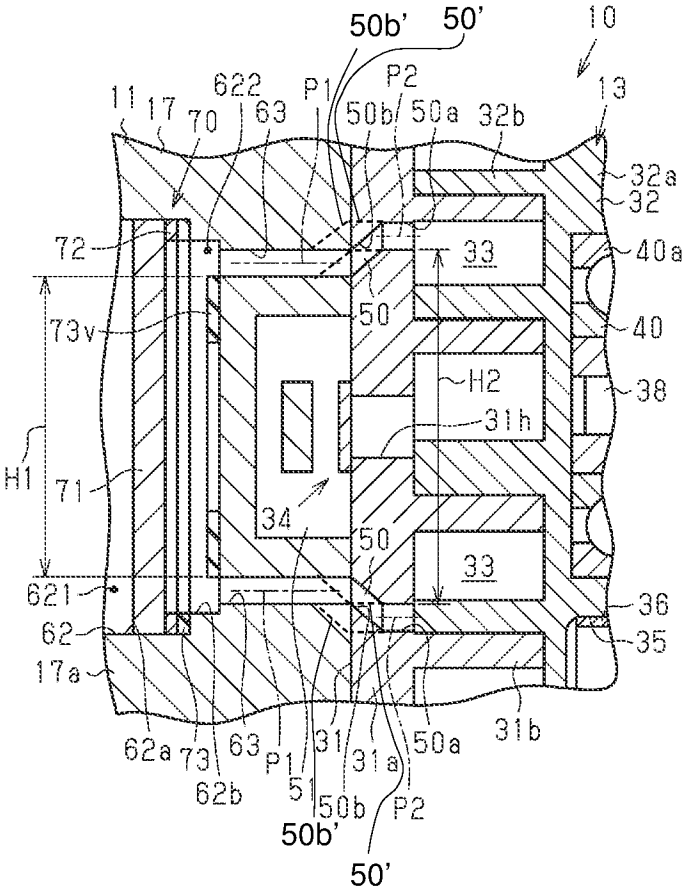
FIG. 7 is an enlarged cross-sectional view showing a part of the scroll compressor.

As shown in FIG. 7, axes P1 of the supply passages 63 extend in parallel with each other. Each injection port 50 includes a first port section 50*a* and a second port section 50*b*. Axes P2 of the first port sections 50*a* extend parallel with each other. The axes P2 of the first port sections 50*a* extend in the same direction as that of the axes P1 of the supply passages 63. Thus, each injection port 50 includes a portion that extends in the same direction as and parallel with the supply passages 63. The axes P1 of the supply passages 63 and the axes P2 of the first port sections 50*a* extend in the same direction as that of the axis L1 of the rotary shaft 12. Each first port section 50*a* has a first end, which opens in a surface of the fixed base plate 31*a* that is close to the movable scroll 32. Each first port section 50*a* has a second end, which is formed inside the fixed base plate 31*a*. The first port sections 50*a* have the same length in the axial direction.

Each second port section 50*b* connects the associated first port section 50*a* to the associated supply passage 63. Each second port section 50*b* has a first end, which is connected to the opening of the associated supply passage 63 on the side opposite to the accommodating recess 62. Each second port section 50*b* has a second end, which is connected to the end of the associated first port section 50*a* on the opposite side to the compression chambers 33. The second end of each first port section 50*a* corresponds to an end of the first port section 50*a* that is on the side opposite to the compression chambers 33.

Each second port section 50*b* extends in a direction diagonally intersecting the axis P1 of the associated supply passage 63 and the axis P2 of the associated first port section 50*a*. Thus, each injection port 50 includes a portion that extends at a predetermined angle with respect to the axis P1 of the associated supply passage 63 and the axis P2 of the associated first port section 50*a*. The second port sections 50*b* approach each other from the second ends toward the first ends. Each supply passage 63 is connected to the associated first port section 50*a* via the associated second port section 50*b*. A distance H1 between the openings of the two supply passages 63 that are closest to the accommodating recess 62 is less than a distance H2 between the openings of the two injection ports 50 that are closest to the compression chambers 33.

An operation of the present embodiment will now be described.

For example, in a high load operation of the scroll compressor 10, refrigerant of the intermediate pressure is introduced to the introduction port 60 from the external refrigerant circuit 25. This opens the check valve 70. Specifically, when the refrigerant of the intermediate pressure is introduced to the introduction port 60 from the external refrigerant circuit 25, the refrigerant of the intermediate pressure passes through the introduction port 60, enters the first chamber 621 of the accommodating recess 62, and flows toward the valve hole 71*h*. Therefore, the accommodating recess 62 functions as an intermediate pressure chamber, into which refrigerant of the intermediate pressure is introduced from the external refrigerant circuit 25.

After flowing into the valve hole 71*h*, the refrigerant of the intermediate pressure flexes the reed valve 72*v*. This causes the reed valve 72*v* to open the valve hole 71*h*, so that the check valve 70 is in an open state. In this state, the refrigerant of the intermediate pressure passes through the valve hole 71*h* and flows into the second chamber 622 of the accommodating recess 62. The refrigerant of the intermediate pressure is then introduced into two of the compression chambers 33 that are in a compression process via the supply passages 63 and the injection ports 50. The injection ports 50 thus introduce the refrigerant of the intermediate pressure in the accommodating recess 62 into two of the compression chambers 33. This increases the flow rate of the refrigerant introduced to the compression chambers 33, thereby improving the performance of the scroll compressor 10 in the high load operation.

The check valve 70 closes to prevent refrigerant from flowing to the introduction port 60 from the injection ports 50 via the supply passages 63 and the accommodating recess 62. Specifically, when the refrigerant of the intermediate pressure stops being introduced to the introduction port 60 from the external refrigerant circuit 25, the reed valve 72*v* returns to the original position (i.e. the position before being flexed by the refrigerant of the intermediate pressure). This closes the valve hole 71*h*, so that the check valve 70 is in a closed state. Accordingly, after flowing from the compression chambers 33 to the injection ports 50, the supply passages 63, and the second chamber 622, the refrigerant is prevented from flowing to the first chamber 621 via the valve hole 71*h*. This prevents backflow of refrigerant from the introduction port 60 to the external refrigerant circuit 25. That is, the check valve 70 prevents backflow of refrigerant from the compression chambers 33 via the supply passages 63 and the injection ports 50.

In order to increase the flow rate of the refrigerant of the intermediate pressure introduced into the compression chambers 33 from the injection ports 50, the diameter of the injection ports 50 may be increased. However, an increase in the diameter of the injection ports 50 may prevent the openings of the injection ports 50 on the side corresponding to the compression chambers 33 from being completely closed by the movable scroll 32 during a compression process of the scroll compressor 10. This may cause the refrigerant to flow to the second chamber 622 of the accommodating recess 62 from the compression chambers 33 in a compression process via the injection ports 50 and the supply passages 63.

In the present embodiment, the distance H1 between the openings of the two supply passages 63 that are closest to the accommodating recess 62 is less than a distance H2 between the openings of the two injection ports 50 that are closest to the compression chambers 33. This configuration minimizes the volume of the second chamber 622, which is the space in the accommodating recess 62 between the check valve 70 and the supply passages 63, unlike a case in which the distance H1 is greater than or equal to the distance H2. This reduces the flow rate of the refrigerant that flows into the second chamber 622 from the compression chambers 33 in a compression process through the injection ports 50 and the supply passages 63. This limits reduction in the compression efficiency of the scroll compressor 10.

The above-described embodiment has the following advantages.

(1) The distance H1 between the openings of the two supply passages 63 that are closest to the accommodating recess 62 is less than a distance H2 between the openings of the two injection ports 50 that are closest to the compression chambers 33. This configuration minimizes the volume of the space in the accommodating recess 62 between the check valve 70 and the two supply passages 63, unlike a case in which the distance H1 between the openings of the supply passages 63 that are closest to the accommodating recess 62 is greater than or equal to the distance H2 between the openings of the two injection ports 50 that are closest to the compression chambers 33. This reduces the flow rate of the refrigerant that flows into the accommodating recess 62 from the compression chambers 33 in a compression process through the injection ports 50 and the supply passages 63. This limits reduction in the compression efficiency of the scroll compressor 10.

(2) The two injection ports 50 each include a portion that extends in the same direction as and parallel with each of the two supply passages 63. Also, each injection port 50 includes a portion that extends at a predetermined angle with respect to the axis P1 of the associated supply passage 63 and the axis P2 of the associated first port section 50*a*. This configuration is suitable to cause the distance H1 between the openings of the two supply passages 63 that are closest to the accommodating recess 62 to be less than the distance H2 between the openings of the two injection ports 50 that are closest to the compression chambers 33.

(3) The flange 23 is held by the peripheral wall 17*b* of the intermediate housing member 17 and the peripheral wall 15*b* of the motor housing member 15. In this state, the bolts 30 are passed through the intermediate housing member 17 and the flange 23 and are threaded to the peripheral wall 15*b* of the motor housing member 15, thereby integrally fixing the shaft support housing member 18 to the intermediate housing member 17 and the motor housing member 15. Thus, the shaft support housing member 18 sufficiently receives the fastening force of the bolts 30. The vibration of the shaft support housing member 18 is therefore easily suppressed. Thus, noise caused by vibration of the shaft support housing member 18 is suppressed. Also, the intermediate housing member 17 has the peripheral wall 17*b*. Thus, the intermediate housing member 17 has a higher stiffness than in a case in which the intermediate housing member 17 does not have the peripheral wall 17*b*. Therefore, even if the opening and closing actions of the check valve 70 transmit vibrations to the intermediate housing member 17, the vibration of the intermediate housing member 17 is easily suppressed. This suppresses generation of noise due to vibration of the intermediate housing member 17. This suppresses generation of noise in the scroll compressor 10.

(4) The intermediate housing member 17 includes the lid 65, which closes the opening of the accommodating recess 62 and separates the accommodating recess 62 and the discharge chamber 68 from each other. The lid 65 has the tubular lid bottom wall 65*a* and the tubular lid peripheral wall 65*b*, which extends from the outer periphery of the lid bottom wall 65*a*. The lid 65 has a tubular shape with a closed end. This increases the stiffness of the lid 65 as compared to a case in which the lid 65 is flat. Accordingly, the stiffness of the intermediate housing member 17, to which the lid 65 is attached, is further increased. Therefore, even if the opening and closing actions of the check valve 70 transmit vibrations to the intermediate housing member 17, the vibration of the intermediate housing member 17 is further easily suppressed. This further suppresses generation of noise due to vibration of the intermediate housing member 17.

(5) The intermediate housing member 17 has the mount legs 75 protruding from the outer circumferential surface. This structure further increases the stiffness of the intermediate housing member 17 as compared to a case in which the intermediate housing member 17 does not have the mount legs 75 on the outer circumferential surface. Therefore, even if the opening and closing actions of the check valve 70 transmit vibrations to the intermediate housing member 17, the vibration of the intermediate housing member 17 is further easily suppressed. This further suppresses generation of noise due to vibration of the intermediate housing member 17.

(6) The peripheral wall 17*b* of the intermediate housing member 17 covers the compression mechanism 13 from the outer side in the radial direction of the rotary shaft 12. The peripheral wall 17*b* of the intermediate housing member 17 thus limits external transmission, from the scroll compressor 10, of noise generated in the compression mechanism 13, such as contact sound of the fixed scroll 31 and the movable scroll 32. This further suppresses generation of noise in the scroll compressor 10.

(7) The lid 65 has a tubular shape with a closed end. This structure increases the volume of the first chamber 621 as compared to a case in which the lid 65 is flat, and thus reduces pulsation of the refrigerant in the first chamber 621. This suppresses generation of noise due to pulsation of the refrigerant. This further suppresses generation of noise in the scroll compressor 10.

The above-described embodiment may be modified as follows. The above-described embodiment and the following modifications can be combined as long as the combined modifications remain technically consistent with each other.

Figure 8:
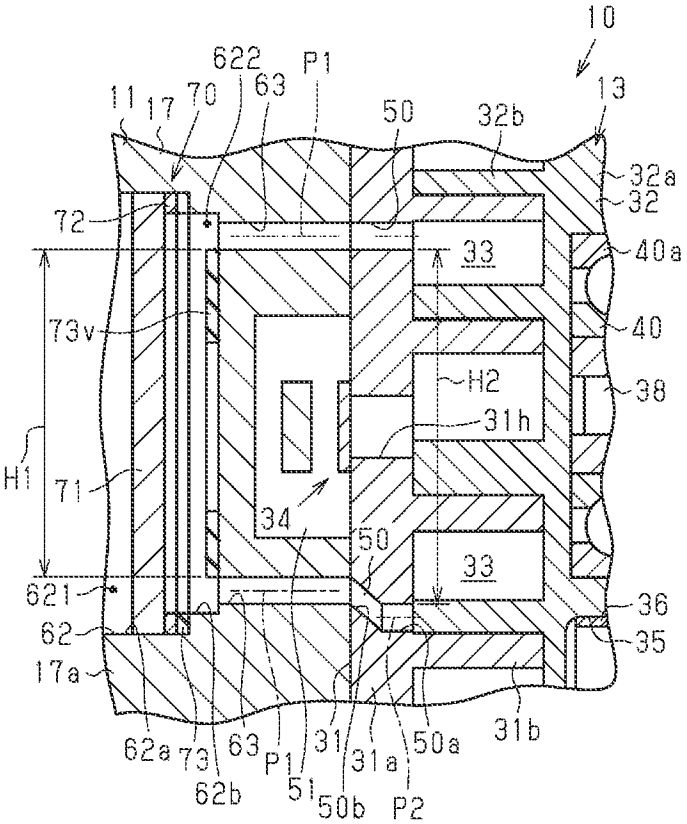
FIG. 8 is an enlarged cross-sectional view showing a part of a scroll compressor according to another embodiment.

As shown in FIG. 8, only one of the two injection ports 50 may include the first port section 50*a* and the second port section 50*b*. In this case, the other one of the two injection ports 50 may be formed to extend entirely on the same axis as the axis P1 of the associated supply passage 63. This configuration may be employed to cause the distance H1 between the openings of the two supply passages 63 that are closest to the accommodating recess 62 to be less than the distance H2 between the openings of the two injection ports 50 that are closest to the compression chambers 33. With this configuration, only one of the two injection ports 50 needs to include the first port section 50*a* and the second port section 50*b*, and the other one of the two injection ports 50 is a straight through-hole formed in the fixed base plate 31*a*. This reduces the number of manufacturing steps for the fixed base plate 31*a*.

Figure 9:
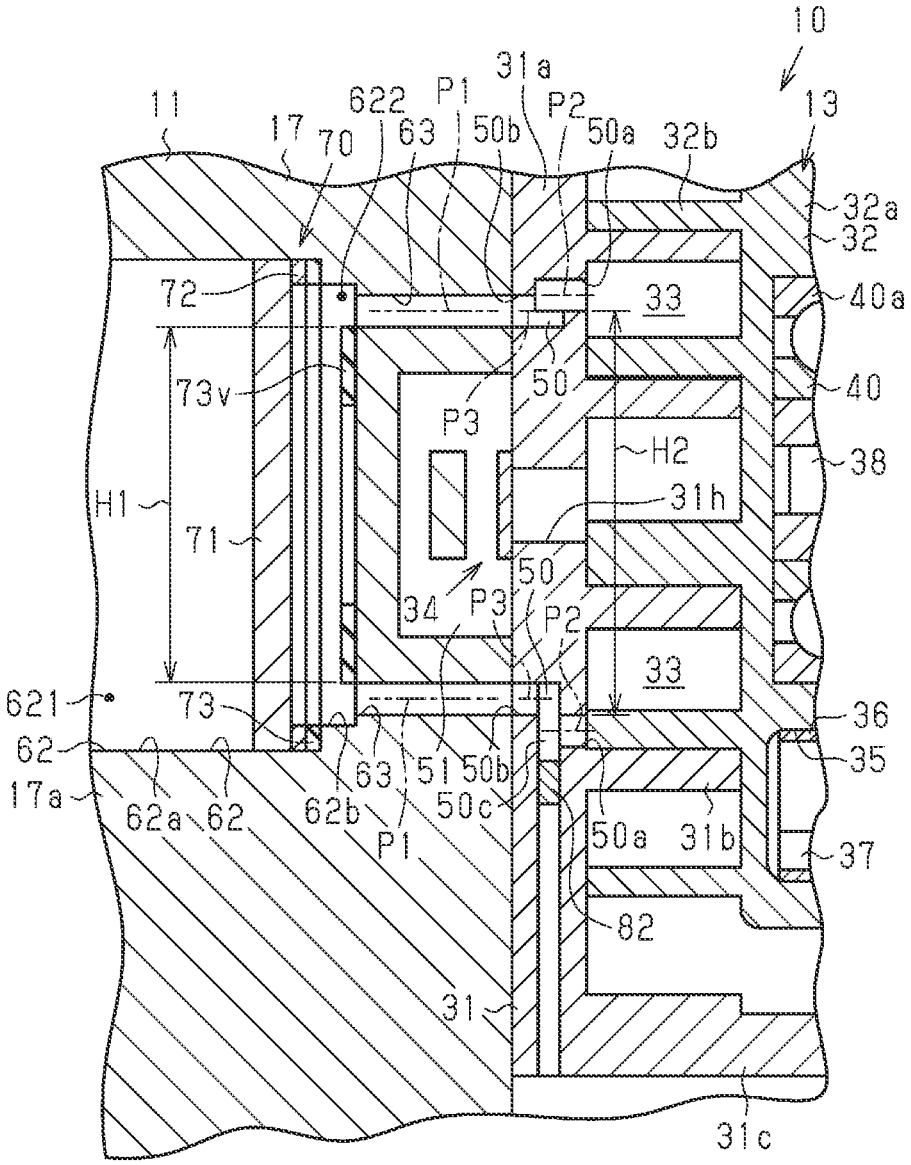
FIG. 9 is an enlarged cross-sectional view showing a part of a scroll compressor according to another embodiment.

As shown in FIG. 9, the second port sections 50*b* of the two injection ports 50 may each have an axis P3 that extends in the same direction as the axes P1 of the two associated supply passages 63 and the axes P2 of the first port sections 50*a*. That is, the second port section 50*b* does not necessarily need to extend in a direction diagonally intersecting the axes P1 of the two supply passages 63 and the axis P2 of the first port section 50*a* of the injection port 50. The axis P3 of the second port section 50*b* agrees with the axis P1 of the supply passage 63, but is displaced inward in the radial direction from the axis P2 of the first port section 50*a*.

In one of the two injection ports 50, the first port section 50*a* and the second port section 50*b* may be directly connected to each other with the axis P2 of the first port section 50*a* and the axis P3 of the second port section 50*b* displaced from each other. In this case, a portion of the second port sections 50*b* overlaps with the first port sections 50*a* when viewed in the direction of the axes P2, P3 of the first port section 50*a* and the second port section 50*b*.

The other one of the two injection ports 50 (the lower injection port 50 in FIG. 9) may be configured such that the first port section 50*a* and the second port section 50*b* do not overlap with each other when viewed in the direction of the axes P2, P3 of the first port section 50*a* and the second port section 50*b*. In this case, the lower injection port 50 may simply have a third port section 50*c*, which connects the first port section 50*a* and the second port section 50*b* to each other, and extends in the radial direction of the rotary shaft 12. Thus, the lower injection port 50 includes a portion that extends at a predetermined angle with respect to the axis P1 of the associated supply passage 63 and the axes P2, P3 of the first port section 50*a* and the second port section 50*b*. The third port section 50*c* extends through the fixed base plate 31*a* from the outer circumferential surface of the fixed base plate 31*a* to the central portion. In this case, the open end of the third port section 50*c* is closed by a closing member 82 such that refrigerant flowing through the third port section 50*c* does not leak from the outer circumferential surface of the fixed base plate 31*a*. This configuration may be employed to cause the distance H1 between the openings of the two supply passages 63 that are closest to the accommodating recess 62 to be less than the distance H2 between the openings of the two injection ports 50 that are closest to the compression chambers 33.

The two supply passages 63 may extend to approach each other from the inner surface of the bottom wall 17*a* of the intermediate housing member 17 toward the bottom surface of the second recess 62*b* of the accommodating recess 62. Also, in the fixed base plate 31*a*, the two injection ports 50 may extend to approach each other from the surface that is closest to the movable scroll 32 toward the surface on the side opposite to the movable scroll 32. The injection ports 50 are respectively connected to the supply passages 63. This configuration may be employed to cause the distance H1 between the openings of the two supply passages 63 that are closest to the accommodating recess 62 to be less than the distance H2 between the openings of the two injection ports 50 that are closest to the compression chambers 33.

Like the injection ports 50, each supply passage 63 may include a first port section 50*a* and a second port section 50*b*. That is, any configuration may be employed as long as the two injection ports 50 (or 50' shown in dashed lines) include a portion that extends in the same direction as and parallel with the two supply passages 63, and at least one of the injection ports 50 or the supply passages 63 includes a portion (second port section 50*b* or section 50*b'* (shown in dashed lines), respectfully) that extends at a predetermined angle with respect to an axis extending in the same direction as the supply passages 63. This configuration allows the distance H1 between the openings of the two supply passages 63 that are closest to the accommodating recess 62 to be less than the distance H2 between the openings of the two injection ports 50 that are closest to the compression chambers 33.

The bolt insertion holes 17*h* do not necessarily need to extend through the peripheral wall 17*b* of the intermediate housing member 17, but may extend only through the bottom wall 17*a* of the intermediate housing member 17. That is, the bolts 30, which extend through the intermediate housing member 17 and the flange 23 and are threaded to the motor housing member 15, may extend through the bottom wall 17*a* of the intermediate housing member 17 and pass through, for example, the inner side of the peripheral wall 17*b* of the intermediate housing member 17, without extending through the peripheral wall 17*b*.

The lid 65 does not necessarily need to have a tubular shape with a closed end, but may be flat. That is, the shape of the lid 65 is not particularly limited as long as the lid 65 can close the opening of the accommodating recess 62 and separate the accommodating recess 62 and the discharge chamber 68 from each other.

The number of the mount legs 75, which protrude from the outer circumferential surface of the intermediate housing member 17, may be one.

The mount legs 75 may be omitted from the outer circumferential surface of the intermediate housing member 17.

The scroll compressor 10 may be configured such that the peripheral wall 17*b* of the intermediate housing member 17 does not cover the compression mechanism 13 from the outer side in the radial direction of the rotary shaft 12. For example, a wall that protrudes from the inner surface of the bottom wall 17*a* of the intermediate housing member 17 may be used as the fixed volute wall 31*b*, and the peripheral wall 17*b* of the intermediate housing member 17 may be used as a fixed outer peripheral wall, which surrounds the fixed volute wall 31*b*. That is, it suffices if a portion of the intermediate housing member 17 has the function of the fixed scroll 31. In this case, a part of the intermediate housing member 17 that functions as the fixed scroll 31 forms a part of the compression mechanism 13.

The shape of the reed valve 72*v* is not particularly limited. It suffices if the distal end of the reed valve 72*v* have a shape capable of opening and closing the valve hole 71*h*.

The shape of the valve hole 71*h* is not particularly limited. In this case, the shape of the distal end of the reed valve 72*v* must be changed to a shape capable of opening and closing the valve hole 71*h*.

The check valve 70 does not necessarily need to have the reed valve 72*v*. For example, the check valve 70 may include a spool valve that reciprocates between an opening position and a closing position depending on the relationship between the urging force of a coil spring and the intermediate pressure of the refrigerant from the introduction port 60. That is, the configuration of the check valve 70 is not particularly limited as long as the check valve 70 is capable of opening when the refrigerant of the intermediate pressure is introduced to the introduction port 60 from the external refrigerant circuit 25, and closing to prevent the refrigerant from flowing to the introduction port 60 from the injection ports 50 via the supply passages 63 and the accommodating recess 62.

The shapes of the two injection ports 50 and the two supply passages 63 do not necessarily need to be circular, but may be elliptic or rectangular. That is, the shapes of the two injection ports 50 and the two supply passages 63 are not particularly limited as long as the distance H1 between the openings of the two supply passages 63 that are closest to the accommodating recess 62 is less than the distance H2 between the openings of the two injection ports 50 that are closest to the compression chambers 33.

The scroll compressor 10 does not need to be of a type that is driven by the electric motor 14, but may be of a type that is driven by a vehicle engine.

In the above-described embodiment, the scroll compressor 10 is used in the vehicle air conditioner. However, the scroll compressor 10 may be used in other apparatuses. For example, the scroll compressor 10 may be mounted on a fuel cell vehicle and use the compression mechanism 13 to compress air, which is fluid supplied to the fuel cell.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

The invention claimed is:

1. A scroll compressor, comprising:

a compression mechanism that includes a fixed scroll and a movable scroll, and compression chambers, which are formed by meshing of the fixed scroll and the movable scroll, wherein the compression mechanism compresses refrigerant that has been drawn into the compression chambers, and discharges the compressed refrigerant; and a housing, which includes an intermediate pressure chamber, wherein refrigerant of an intermediate pressure is introduced into the intermediate pressure chamber from an external refrigerant circuit, the intermediate pressure being higher than a suction pressure of the refrigerant drawn into the compression chambers and lower than a discharge pressure of the refrigerant discharged from the compression chambers, wherein the compression mechanism includes two injection ports, which respectively introduce the refrigerant of the intermediate pressure in the intermediate pressure chamber into two of the compression chambers, the housing includes two supply passages and a check valve, the two supply passages are connected to the intermediate pressure chamber and respectively supply the refrigerant of the intermediate pressure to the two injection ports, the check valve prevents backflow of the refrigerant from the compression chambers via the two supply passages and the two injection ports, the two supply passages include openings that open into the intermediate pressure chamber, the two injection ports include openings that open into the compression chambers, and a distance between points of the openings of the two supply passages that are farthest apart from each other is less than a distance between points of the openings of the two injection ports that are farthest apart from each other.

2. The scroll compressor according to claim 1, wherein each of the two injection ports includes a portion that extends in a same direction as and parallel with each of the two supply passages, and the two injection ports or the two supply passages each include a portion that extends at a predetermined angle with respect to an axis that extends in the same direction.

3. The scroll compressor according to claim 2, wherein the two injection ports each include a first port section that extends in the same direction as and parallel with the associated supply passage, and a second port section that extends at a predetermined angle with respect to an axis of the first port section, each first port section opens in a surface of the fixed scroll that faces is relatively close to the movable scroll, and includes an end located inside the fixed scroll on a side opposite to the compression chambers, and each second port section includes a first end, which is connected to an opening of the associated supply passage on a side opposite to the intermediate chamber, and a second end, which is connected to the end of the associated first port section on the side opposite to the compression chamber.

4. The scroll compressor according to claim 3, wherein the second port sections of the two injection ports approach each other from the second ends toward the first ends.

5. The scroll compressor according to claim 4, wherein the first port section of the two injection ports have a same length in an axial direction.

* * * * *